US009530361B2

(12) United States Patent
Matsui

(10) Patent No.: US 9,530,361 B2
(45) Date of Patent: Dec. 27, 2016

(54) DRIVING DEVICE AND DRIVING METHOD FOR CONTROLLING BACKLIGHT OF DISPLAY DEVICE

(71) Applicant: NEC Display Solutions, Ltd., Tokyo (JP)

(72) Inventor: Katsuyuki Matsui, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 0 days.

(21) Appl. No.: 14/894,482

(22) PCT Filed: May 29, 2013

(86) PCT No.: PCT/JP2013/064919

§ 371 (c)(1),
(2) Date: Nov. 27, 2015

(87) PCT Pub. No.: WO2014/192100

PCT Pub. Date: Dec. 4, 2014

(65) Prior Publication Data

US 2016/0117998 A1 Apr. 28, 2016

(51) Int. Cl.
*G09G 3/36* (2006.01)
*G09G 3/20* (2006.01)
(Continued)

(52) U.S. Cl.
CPC ..... *G09G 3/3406* (2013.01); *H05B 33/0851* (2013.01); *G09G 2320/0626* (2013.01); *G09G 2354/00* (2013.01); *G09G 2360/14* (2013.01)

(58) Field of Classification Search
CPC ..... G09G 3/3406; G09G 2320/0626; G09G 2354/00; G09G 2360/14; H05B 33/0851
(Continued)

(56) References Cited

U.S. PATENT DOCUMENTS 7,460,103 B2 * 12/2008 Konno ..... G09G 3/3426 345/102
2005/0184952 A1 * 8/2005 Konno ..... G09G 3/3426 345/102
2012/0106867 A1 * 5/2012 Yamada ..... H04N 1/6027 382/274

FOREIGN PATENT DOCUMENTS

JP 2005-258403 A 9/2005
JP 2007-318050 A 12/2007
(Continued)

OTHER PUBLICATIONS

International Search Report in PCT/JP2013/064919 dated Jul. 9, 2013 with an English Translation thereof.

*Primary Examiner* — Daniel D Chang
(74) *Attorney, Agent, or Firm* — McGinn IP Law Group, PLLC

(57) ABSTRACT

A driving device includes a drive normalization part configured to calculate a reference light quantity measurement which is estimated when a backlight is driven using the predetermined reference BL-drive value based on a current BL-drive value and a light quantity measurement of the backlight; a low-pass filter configured to calculate a moving average among a plurality of reference light quantity measurements being temporarily held, thus outputting the smoothed reference light quantity measurement precluding noise; and a BL-drive value calculation part configured to calculate a target BL-drive value which allows the smoothed reference light quantity measurement to match the target light quantity corresponding to a user's setting of luminance.

7 Claims, 12 Drawing Sheets

(51) Int. Cl.
*G09G 3/34* (2006.01)
*H05B 33/08* (2006.01)

(58) Field of Classification Search
USPC ..... 315/151; 345/102, 104, 690; 349/69
See application file for complete search history.

(56) References Cited

FOREIGN PATENT DOCUMENTS

| | | | |
|---|---|---|---|
| JP | 2010-271480 | A | 12/2010 |
| JP | 2012-155944 | A | 8/2012 |

* cited by examiner

DRIVING DEVICE AND DRIVING METHOD FOR CONTROLLING BACKLIGHT OF DISPLAY DEVICE

TECHNICAL FIELD

The present invention relates to a driving device and a driving method configured to control the light quantity of a backlight in a display device.

BACKGROUND ART

Recently, liquid crystal display devices have employed LED backlights including light sources using LED (Light Emitting Diode). Generally speaking, liquid crystal display devices using LED backlights are equipped with a function of changing the luminance of a backlight with a user's preferable luminance based on a user's instruction. Due to individual differences of LEDs in terms of actual hues and light quantities, however, individual backlights may vary in luminance irrespective of the same driving condition. Additionally, LEDs may vary in outputs depending on operating conditions such that light quantities will be reduced in proportion to increasing temperatures. Therefore, it is difficult to stabilize the luminance of a backlight at a user's preferable luminance irrespective of individual differences and operating conditions even when the operation of a backlight is solely controlled based on a user's specified luminance.

To solve the aforementioned problem, engineers have proposed a method of using an optical sensor which is able to measure the light quantity of received light (e.g. Patent Literature Document 1). The optical sensor receives part of the light emitted from a backlight so as to measure the light quantity of light actually emitted from a backlight. A BL (backlight) driver carries out a control operation (e.g. a feedback control) to successively adjust a driving condition for a backlight based on a light quantity measurement obtained from the optical sensor.

In general, the aforementioned BL driver includes a low-pass filter which carries out a stabilization process to eliminate noise from the light quantity measurement input from the optical sensor. Thus, the BL driver achieves stabilized feedback control.

CITATION LIST

Patent Literature Document

Patent Literature Document 1: Japanese Patent Application Publication No. 2007-318050

SUMMARY OF INVENTION

Technical Problem

However, the aforementioned BL driver has the following problems. That is, a user's operation to significantly change a setting of luminance for a backlight may create a problem of overshooting in which the luminance of a backlight is significantly reduced below or increased above a target luminance due to a delay of the low-pass filter.

On the other hand, a reduction of a feedback speed can prevent overshooting but creates another problem in that the time for the luminance of a backlight to reach a target luminance is increased due to a low feedback speed.

As described above, a liquid crystal display device including the aforementioned BL driver needs to reduce a feedback control speed in order to suppress the occurrence of overshooting due to a low-pass filter. As a result, a user's operation to change a setting of luminance for a backlight may create a further problem in that the time for the actual luminance of a backlight to reach the newly-set luminance is increased.

Thus, the present invention aims to provide a driving device configured to solve the above problems, a driving method, and a program.

Solution to Problem

The present invention is made to solve the above problems and directed to a driving device configured to change the quantity of light emitted from a backlight based on the predetermined BL-drive value. The driving device includes a drive normalization part configured to calculate a reference light quantity measurement representing a light quantity measurement which is estimated and obtained from an optical sensor when the backlight is driven using a predetermined reference BL-drive value at the current time based on a current BL-drive value, representing a BL-drive value at the current time, and a light quantity measurement, representing a numerical value of a light quantity of the backlight driven by the current BL-drive value, which is obtained from the optical sensor; a low-pass filter configured to calculate a moving average among a plurality of reference light quantity measurements being temporarily held, thus outputting a smoothed reference light quantity measurement precluding noise; and a BL-drive value calculation part configured to calculate a target BL-drive value representing a BL-drive value which allows the smoothed reference light quantity measurement to match a target light quantity based on the smoothed reference light quantity measurement and the target light quantity based on a user's setting of luminance.

The present invention is directed to a driving method for changing the quantity of light emitted from a backlight based on the predetermined BL-drive value. The driving method includes a drive normalization part configured to calculate a reference light quantity measurement representing a light quantity measurement which is estimated and obtained from an optical sensor when the backlight is driven using a predetermined reference BL-drive value at the current time based on a current BL-drive value, representing a BL-drive value at the current time, and a light quantity measurement, representing a numerical value of a light quantity of the backlight driven by the current BL-drive value, which is obtained from the optical sensor; a low-pass filter configured to calculate a moving average among a plurality of reference light quantity measurements being temporarily held, thus outputting a smoothed reference light quantity measurement precluding noise; and a BL-drive value calculation part configured to calculate a target BL-drive value representing a BL-drive value which allows the smoothed reference light quantity measurement to match a target light quantity based on the smoothed reference light quantity measurement and the target light quantity based on a user's setting of luminance.

The present invention is directed to a program causing a computer of a driving device, configured to change the quantity of light emitted from a backlight based on the predetermined BL-drive value, to implement functions including: drive normalization means configured to calculate a reference light quantity measurement representing a light quantity measurement which is estimated and obtained from an optical sensor when the backlight is driven using a predetermined reference BL-drive value at the current time based on a current BL-drive value, representing a BL-drive value at the current time, and a light quantity measurement, representing a numerical value of a light quantity of the backlight driven by the current BL-drive value, which is obtained from the optical sensor; low-pass filter means configured to calculate a moving average among a plurality of reference light quantity measurements being temporarily held, thus outputting a smoothed reference light quantity measurement precluding noise; and BL-drive value calculation means configured to calculate a target BL-drive value representing a BL-drive value which allows the smoothed reference light quantity measurement to match a target light quantity based on the smoothed reference light quantity measurement and the target light quantity based on a user's setting of luminance

Advantageous Effects of Invention

According to the driving device of the present invention, it is possible to reduce the time for adjusting the luminance of a backlight to a user's preferable luminance

DESCRIPTION OF EMBODIMENTS (Problems in a Driving Device Relating to the Present Invention)

Figure 11:
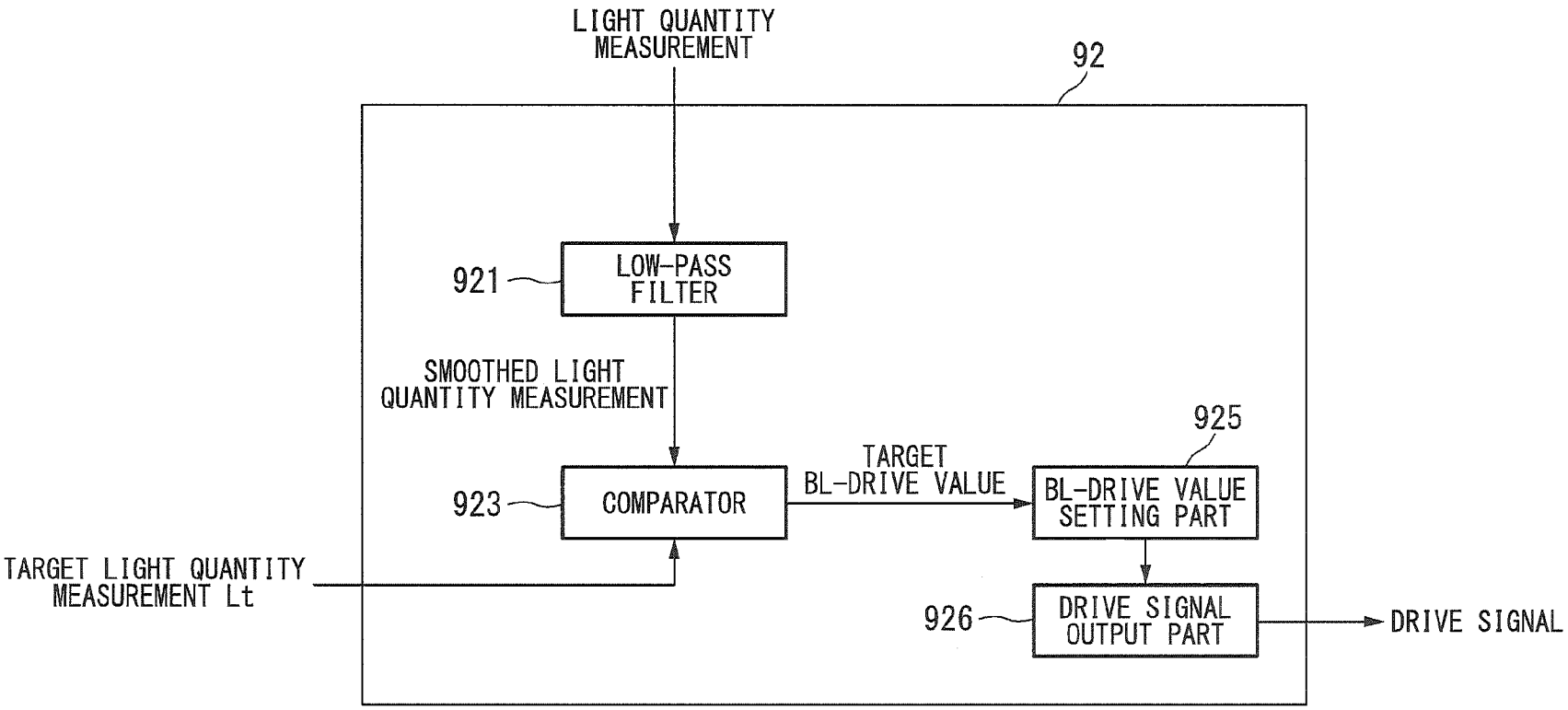
FIG. 11 is a block diagram showing the functional configuration of a driving device of a backlight relating to the present invention.

FIG. 11 is a block diagram showing the functional configuration of a driving device of a backlight relating to the present invention. In FIG. 11, reference sign 92 denotes the driving device of a backlight.

Figure 12:
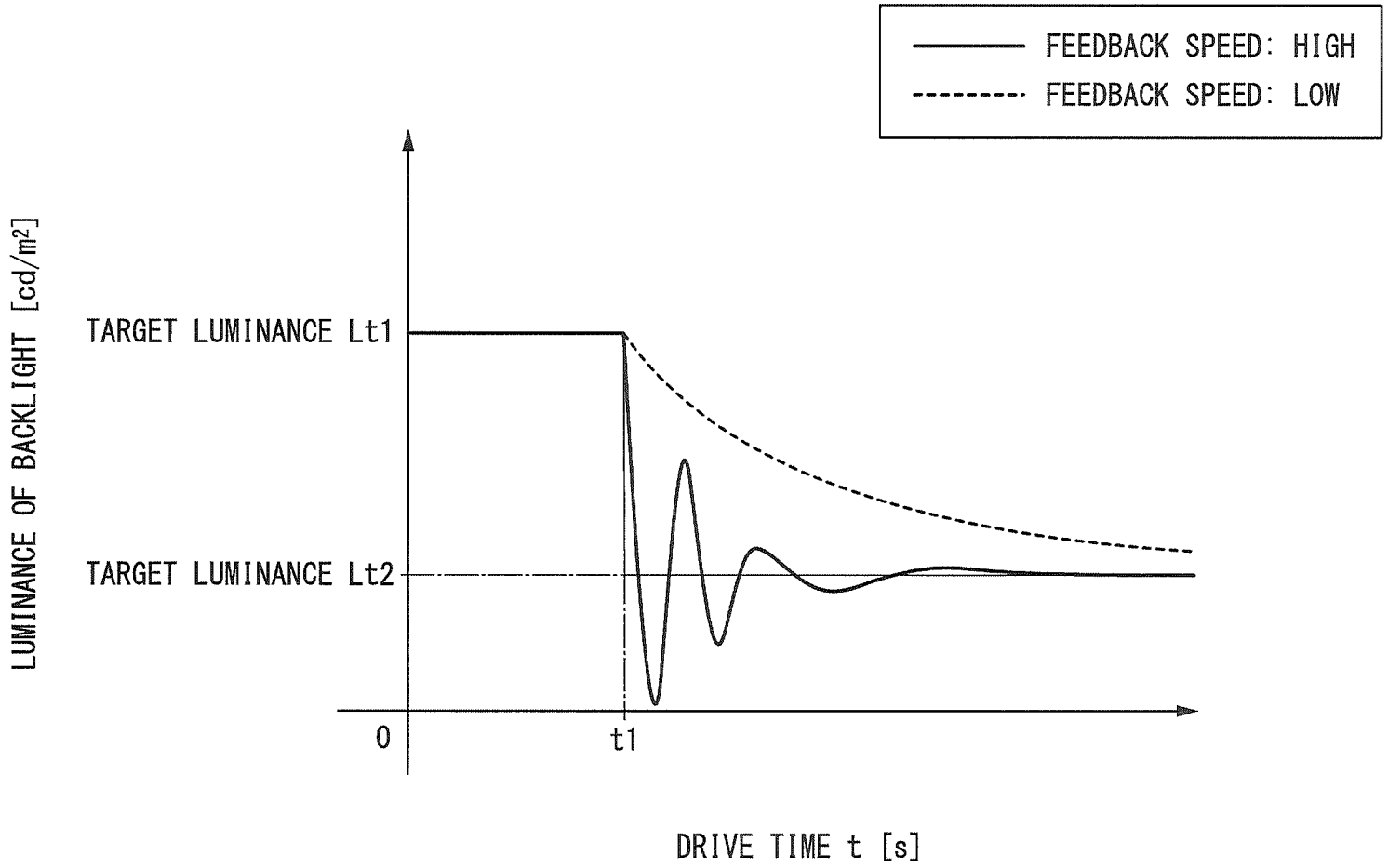
FIG. 12 is a graph used to explain a feedback control via the driving device of a backlight relating to the present invention.

FIG. 12 is a graph used to explain a feedback control using the driving device of a backlight relating to the present invention.

First, an example of the driving device, which carries out a feedback control using an optical sensor, relating to the present invention and its problems will be described with reference to FIGS. 11 and 12. As shown in FIG. 11, the driving device 92 includes a low-pass filter 921, a comparator 923, a BL-drive value setting part 925, and a drive signal output part 926.

The driving device 92 is designed to set a BL-drive value based on a target light quantity, which is based on a user's setting of luminance, and a light quantity measurement of a backlight obtained from an optical sensor, thus outputting a drive signal to a backlight based on the BL-drive value. The driving device 92 outputs the drive signal, i.e. a pulse signal made of the predetermined Duty ratio [%], to a backlight. In this case, the BL-drive value refers to the Duty ratio (i.e. a ratio of ON-time for each unit pulse). For example, the driving device 92 can reduce a lighting time (=ON-time) of a backlight by reducing the BL-drive value, i.e. the Duty ratio, thus reducing the luminance of a backlight. Additionally, the driving device 92 can increase a lighting time of a backlight by increasing the BL-drive value, thus increasing the luminance of a backlight.

The low-pass filter 921 is a functional part configured to eliminate noise in a light quantity measurement input from an optical sensor, which is generally referred to as a digital low-pass filter. The low-pass filter 921, serving as a digital low-pass filter, temporarily holds a plurality of light quantities which are successively input thereto so as to output a smoothed light quantity measurement by calculating a moving average among light quantities.

The comparator 923 inputs a smoothed light quantity measurement, i.e. a noise-eliminated value of a light quantity measurement. Additionally, the comparator 923 inputs a target light quantity based on a user's setting of luminance The comparator 923 determines the relationship of magnitude by way of a comparison between the smoothed light quantity measurement and the target light quantity measurement.

The BL-drive value setting part 925 is a functional part configured to set (or change) a BL-drive value based on the determination result of the comparator 923. Specifically, the BL-drive value setting part 925 carries out a process to reduce the current BL-drive value (Duty ratio) when the comparator 923 determines that the smoothed light quantity measurement is higher than the target light quantity measurement. In contrast, the BL-drive value setting part 925 carries out a process to increase the current BL-drive value (Duty ratio) when the comparator 923 determines that the smoothed light quantity measurement is lower than the target light quantity.

In the above processes of the BL-drive value setting part 925, a large variance of a BL-drive value for each determination result increases a feedback speed (i.e. a speed at which the smoothed light quantity measurement approaches the target light quantity) while a small variance of a BL-drive value for each determination result decreases a feedback speed.

The drive signal output part 926 is a functional part configured to output a drive value, corresponding to a BL-drive value (Duty ratio) being set by the BL-drive value setting part 925, to a backlight.

As described above, the driving device 92 can achieve a feedback control to stabilize the luminance of a backlight at the target light quantity by use of the BL-drive value setting part 925 configured to set a BL-drive value based on the relationship of magnitude between the target light quantity and the light quantity measurement (i.e. the smoothed light quantity measurement) obtained from an optical sensor. Thus, it is possible to stabilize the luminance of a backlight at the target luminance irrespective of individual differences of backlights and their operating environments (e.g. temperature drifting).

Using the low-pass filter 921, the driving device 92 can stabilize a light quantity measurement input from an optical sensor at a noise-eliminated value of the smoothed light quantity measurement. In the driving device 92 precluding the low-pass filter 921, the comparator 923 may vary in determination result depending on light quantity measurements including some noise. As a result, it is difficult for the driving device 92 to stabilize the luminance of a backlight at the target luminance. For this reason, the driving device 92 of a backlight relating to the present invention can achieve a stabilized feedback control by use of the low-pass filter 921.

However, the aforementioned driving device 92 suffers from the following problems. Assume a situation in which a user changes a setting of luminance. At this time, the comparator 923 inputs a new target light quantity based on a setting of luminance after changing. Next, the BL-drive value setting part 925 inputs the determination result of the comparator 923 so as to change a BL-drive value. Subsequently, the drive signal output part 926 outputs a drive signal based on the newly-changed BL-drive value.

Accordingly, the luminance of a backlight will vary based on the newly-changed BL-drive value. Subsequently, an optical sensor produces a light quantity measurement at a backlight whose luminance has been changed so as to newly input the light quantity measurement to the low-pass filter 921.

The smoothed light quantity measurement output from the low-pass filter 921 is calculated by way of a moving average reflecting a light quantity measurement before changing the luminance of a backlight. That is, the smoothed light quantity measurement gradually varies with a delay after the actual luminance of a backlight.

Thus, the comparator 923 should determines relationship of magnitude by way of a comparison between the target light quantity and the smoothed light quantity measurement which varies with a delay after the actual luminance of a backlight. In this case, the actual luminance of a backlight varies depending on a feedback speed of the BL-drive value setting part 925.

FIG. 12 shows a graph using a vertical axis representing the actual luminance of a backlight and a horizontal axis representing the elapsed time.

The graph of FIG. 12 shows the varying luminance of a backlight when a user changes the target luminance from a target luminance Lt1 to a target luminance Lt2 at time t1.

The actual luminance of a backlight will vary as shown in the graph of FIG. 12 when the BL-drive value setting part 925 carries out a feedback control based on the relationship of magnitude between the target light quantity and the smoothed light quantity measurement which varies with a delay after the actual luminance of a backlight.

The case of a large variance of a BL-drive value, i.e. a high feedback speed, for one determination result will be described. In this case, the BL-drive value setting part 925 works to further change the luminance since the smoothed light quantity measurement, which varies with a delay, deviates from the target luminance Lt2 even though the actual luminance of a backlight is approaching the target luminance Lt2. This results in the occurrence of overshooting in which the actual luminance of a backlight becomes significantly lower than or higher than the target luminance (see a solid curve in FIG. 12).

In the case of a small variance of a BL-drive value, i.e. a low feedback speed, for one determination result, the luminance of a backlight will gradually vary so as to decrease a delay (or an error) between the actual luminance of a backlight and the smoothed light quantity measurement output from the low-pass filter 921. Thus, the BL-drive value setting part 925 should set a BL-drive value based on the smoothed light quantity measurement which varies approximately in correspondence with the actual luminance of a backlight; hence, it is possible to prevent the occurrence of the aforementioned overshooting. In this case, however, the driving device 92 decreases a feedback speed but increases the time for the luminance of a backlight to reach the target luminance (see a dotted curve in FIG. 12).

As described above, the driving device 92 needs to decrease a feedback speed in order to suppress the occurrence of overshooting due to the low-pass filter 921. This may cause a problem of an increased time for the actual luminance of a backlight to reach the newly-set luminance when a user changes a setting of luminance for a backlight.

(Minimum Configuration of a Driving Device According to the Present Invention)

Hereinafter, a driving device according to the first embodiment of the present invention will be described with reference to the drawings.

Figure 1:
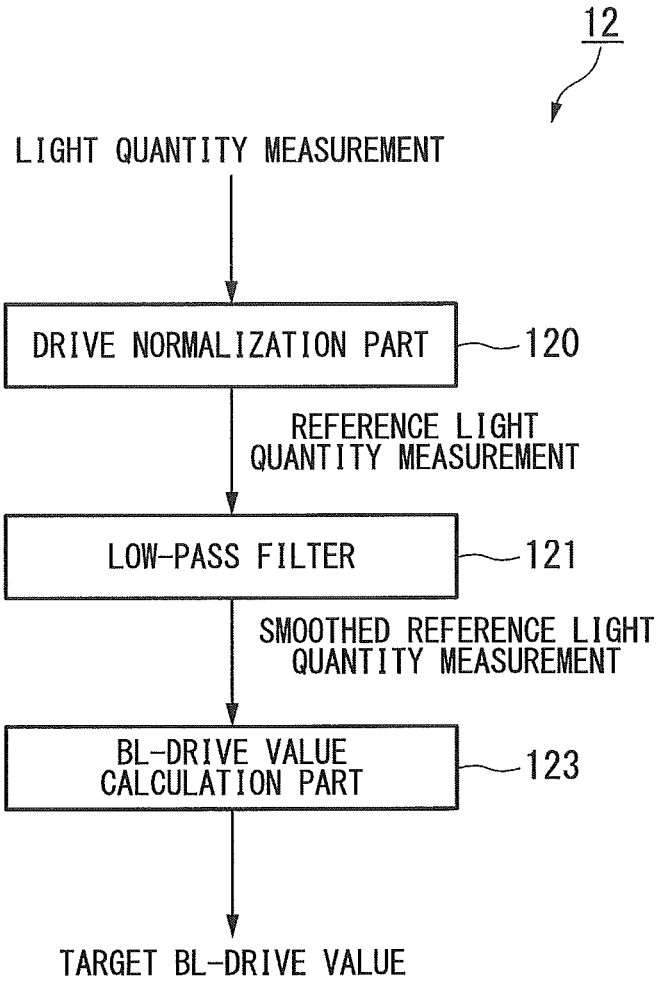
FIG. 1 is a block diagram showing the minimum configuration of a driving device according to the first embodiment of the present invention.

FIG. 1 is a block diagram showing the minimum configuration of a driving device according to the first embodiment of the present invention. In FIG. 1, reference sign 12 denotes a driving device.

As shown in FIG. 1, a driving device 12 is a driving device configured to change the quantity of light emitted from a backlight based on the predetermined BL-drive value, and includes a drive normalization part 120, a low-pass filter 121, and a BL-drive value calculation part 123.

The drive normalization part 120 inputs a current BL-drive value, representing a BL-drive value at the current time, and a light quantity measurement obtained from an optical sensor, i.e. a numerical value representing a light quantity of a backlight being driven with the current BL-drive value. The drive normalization part 120 calculates a reference light quantity measurement, i.e. an estimated light quantity measurement which would be obtained from an optical sensor, when a backlight is driven with the predetermined reference BL-drive value at the current time.

The low-pass filter 121 outputs a noise-eliminated value of the smoothed reference light quantity measurement based on a plurality of reference light quantity measurements.

The BL-drive value calculation part 123 calculates a target BL-drive value, i.e. a BL-drive value which allows the smoothed reference light quantity to match the target light quantity, based on the smoothed reference light quantity measurement and the target light quantity which is based on a user's setting of luminance.

(Overall Configuration of a Liquid Crystal Display Device According to the Present Invention)

Hereinafter, the configuration of a liquid crystal display device incorporating the driving device 12 shown in FIG. 1 will be described in detail.

Figure 2:
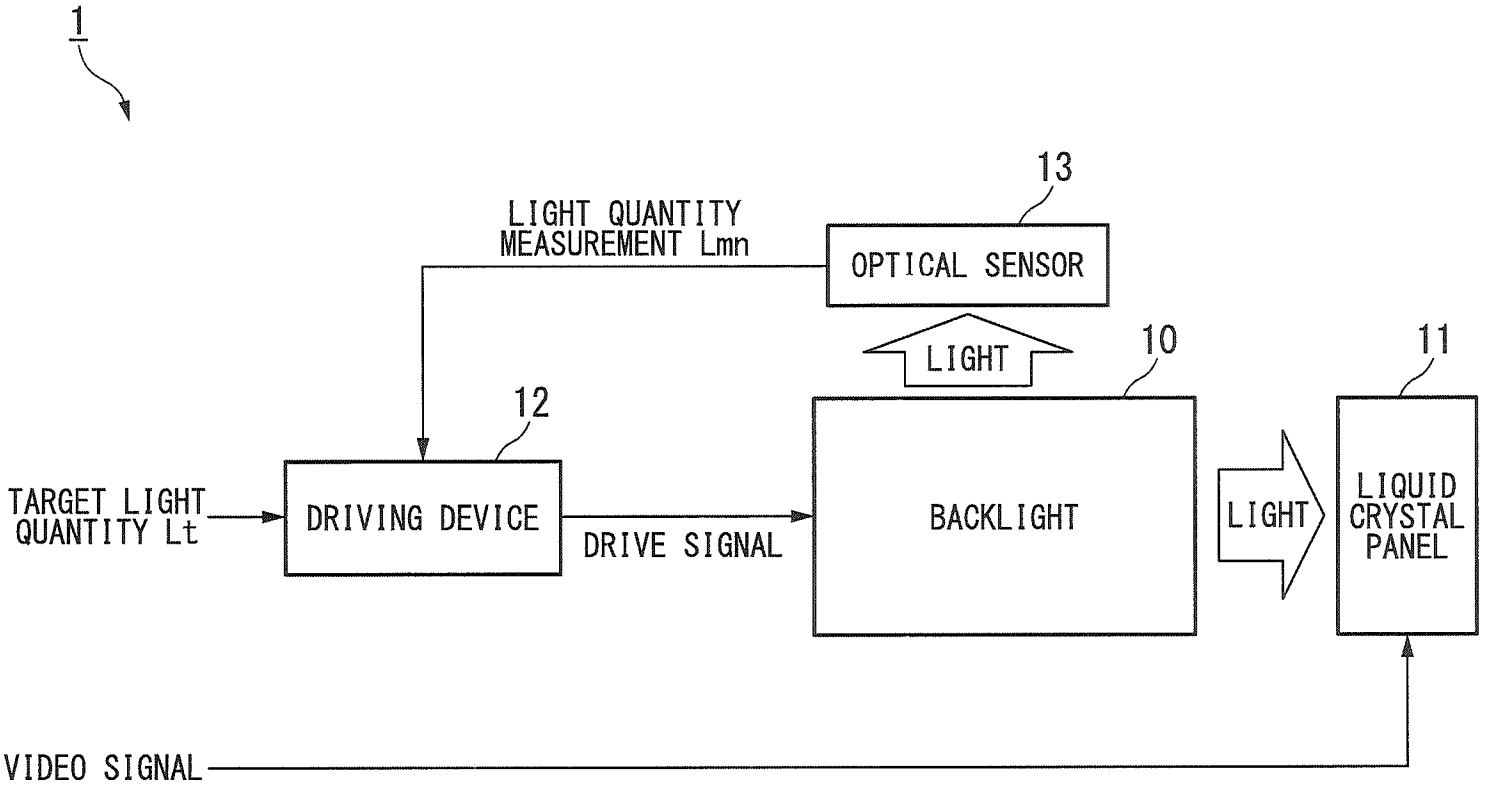
FIG. 2 is a block diagram showing the functional configuration of a liquid crystal display device according to the first embodiment of the present invention.

FIG. 2 is a block diagram showing the functional configuration of a liquid crystal display device according to the first embodiment of the present invention.

As shown in FIG. 2, a liquid crystal display device 1 is a liquid crystal display including a backlight 10, a liquid crystal panel 11, the driving device 12, and an optical sensor 13.

The backlight 10 is designed to emit a light based on a drive signal input from the driving device 12. The backlight 10 may be an LED backlight using LEDs having R (red), G (green), and B (blue) colors, an LED backlight using a white-color LED as a light source, or a generally-known backlight using a cold-cathode tube as a light source.

The liquid crystal panel 11 is a functional part configured to produce an image based on a video signal input from an external device, thus having a viewer visually recognize the image using incident light from the backlight 10.

The driving device 12 according to the present embodiment is a functional part configured to control and drive the backlight 10 based on a target light quantity, which is based on a setting of luminance specified by a user, and a light quantity measurement, representing the luminance of the backlight 10, input from the optical sensor 13 which will be described later. Specifically, the driving device 12 is designed to set a BL-drive value based on a target light quantity, which is based on a user's setting of luminance, and a light quantity measurement obtained from the optical sensor 13, thus outputting a drive signal to the backlight 10 based on the BL-drive value. The driving device 12 outputs the drive signal, i.e. a pulse signal made of the predetermined Duty ratio [%], to the backlight 10. In this case, the BL-drive value refers to the Duty ratio (i.e. a ratio of ON-time for each unit pulse). For example, the driving device 12 can reduce the BL-drive value, i.e. the Duty ratio, so as to reduce the lighting time (=ON-time) of the backlight 10, thus decreasing the luminance. Alternatively, the driving device 12 can increase the BL-drive value so as to increase the lighting time of the backlight 10, thus increasing the luminance.

Ordinarily, the driving device 12 carries out a process to decrease the current BL-drive value (Duty ratio) in response to an input light quantity measurement higher than the target light quantity, while the driving device 12 carries out a process to increase the current BL-drive value (Duty ratio) in response to an input light quantity measurement lower than the target light quantity. As described above, the driving device 12 achieves a feedback control to stabilize the luminance of the backlight 10 at the target light quantity. Thus, it is possible for the liquid crystal display device 1 to stabilize the luminance of the backlight 10 at the target luminance irrespective of individual differences of the backlight 10 and operating environments (e.g. temperature drifting).

The optical sensor 13 is a digital optical sensor configured to receive part of light emitted from the backlight 10 so as to output a numerical value representing the quantity of received light. The optical sensor 13 detects the quantity of light being received in the predetermined unit time, digitizes the light quantity, and successively outputs numerical values. In this connection, the optical sensor 13 can be configured of digital color sensors used to detect quantities of R (red) components, G (green) components, and B (blue) components included in the received light. In this case, it is necessary to set the target light quantity for each of R, G, and B colors; hence, the driving device 12 carries out a process which allows a light quantity measurement for each of R, G, and B colors to match a target light quantity for each of R, G, and B colors.

(Functional Configuration of a Driving Device)

Figure 3:
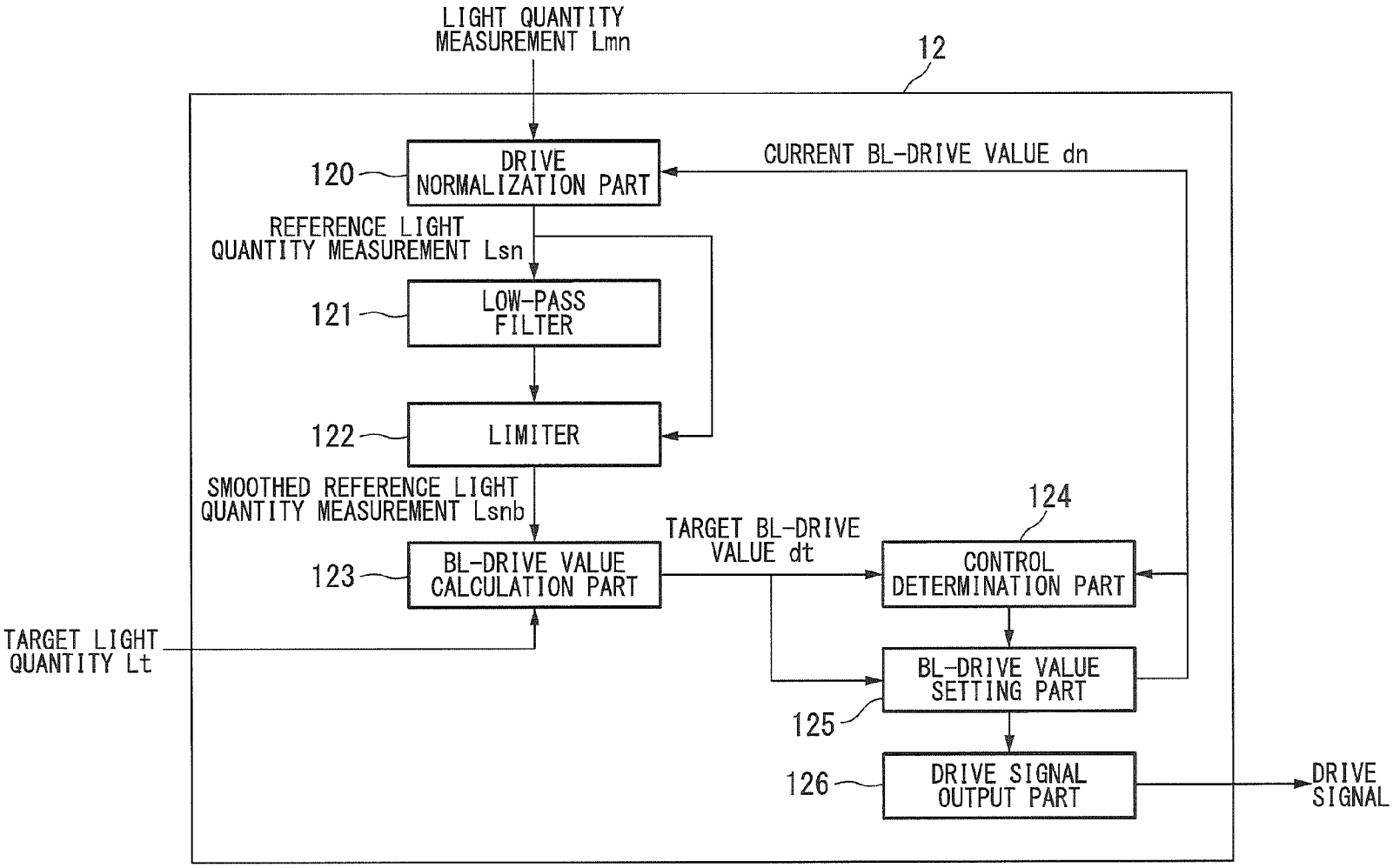
FIG. 3 is a block diagram showing the functional configuration of the driving device according to the first embodiment of the present invention.

FIG. 3 is a block diagram showing the functional configuration of a driving device according to the first embodiment of the present invention.

As shown in FIG. 3, the driving device 12 includes the drive normalization part 120, the low-pass filter 121, a limiter 122, the BL-drive value calculation part 123, a control determination part 124, a BL-drive value setting part 125, and a drive signal output part 126.

The drive normalization part 120 is a processing part configured to convert a light quantity measurement Lmn, which is obtained from the optical sensor 13 at the current time, into a reference light quantity measurement Lsn representing a measured value excluding an influence of a BL-drive value (i.e. a current BL-drive value dn [%]) which is set at the current time. Specifically, the drive normalization part 120 inputs the current BL-drive value, i.e. a BL-drive value at the current time, from the BL-drive value setting part 125 which will be described later. Additionally, the drive normalization part 120 inputs the light quantity measurement Lmn representing the light quantity of the backlight 10 which is driven using the current BL-drive value dn at the current time. The drive normalization part 120 calculates the reference light quantity measurement Lsn, i.e. an estimated light quantity measurement which would be obtained from the optical sensor 13 when the backlight 10 is driven using the predetermined reference BL-drive value dp, on the precondition that the light quantity measurement Lmn is obtained from the optical sensor 13 when the backlight 10 is driven using the current BL-drive value dn at the current time. The specific processing will be described later.

The low-pass filter 121 is a functional part configured to input a plurality of reference light quantity measurements Lsn successively output from the drive normalization part 120 so as to output a noise-eliminated value of a smoothed reference light quantity measurement Lsnb. The low-pass filter 121 is a functional part configured to eliminate noise from a light quantity measurement input by the optical sensor 13, which is generally called a digital low-pass filter. The low-pass filter 121 serving as a digital low-pass filter temporarily holds a plurality of reference light quantity measurements Lsn successively input thereto so as to calculate a moving average among them, thus outputting the smoothed reference light quantity measurement Lsnb.

The limiter 122 is a processing part configured to correct the smoothed reference light quantity measurement Lsnb, which is obtained by way of the drive normalization part 120 and the low-pass filter 121, within the range between an upper-limit reference light quantity Lsmax and a lower-limit reference light quantity Lsmin which are determined in advance. The specific configuration of the limiter 122 will be described later.

The BL-drive value calculation part 123 calculates a BL-drive value (i.e. a target BL-drive value dt) which allows the current luminance of the backlight 10 to match the target light quantity Lt, which is based on a user's setting of luminance, while keeping the correspondence between the noise-eliminated value of the smoothed reference light quantity measurement Lsnb and the reference BL-drive value dp. Specifically, the BL-drive value calculation part 123 inputs the smoothed reference light quantity measurement Lsnb and the target light quantity Lt at first. Then, the BL-drive value calculation part 123 calculates a target BL-drive value based on a BL-drive value which is used to drive the backlight 10 so as to obtain the target light quantity Lt from the optical sensor 13 on the precondition that the smoothed reference light quantity measurement Lsnb is obtained from the optical sensor 13 when the backlight 10 is driven using the reference BL-drive value dp at the current time. The specific processing will be described later.

The control determination part 124 sets a predetermined control coefficient k based on a difference between the target BL-drive value dt and the current BL-drive value dn.

The BL-drive value setting part 125 sets the current BL-drive value to a new value based on the target BL-drive value dt, the current BL-drive value dn, and the control coefficient k. Specifically, the BL-drive value setting part 125 carries out a process to mix the target Bl-drive value dt and the current BL-drive value dn at a ratio corresponding to the control coefficient k. This makes it possible to control the current BL-drive value dn to gradually approach the target BL-drive value dt. Additionally, it is possible to adjust a feedback speed (i.e. a speed at which the current BL-drive value gradually approaches the target BL-drive value dt) based on the control coefficient k.

The drive signal output part 126 is a functional part configured to output a drive signal (i.e. a pulse signal), corresponding to the BL-drive value (Duty ratio) set by the BL-drive value setting part 125, to the backlight 10.

(Process of the Drive Normalization Part)

Figure 4:
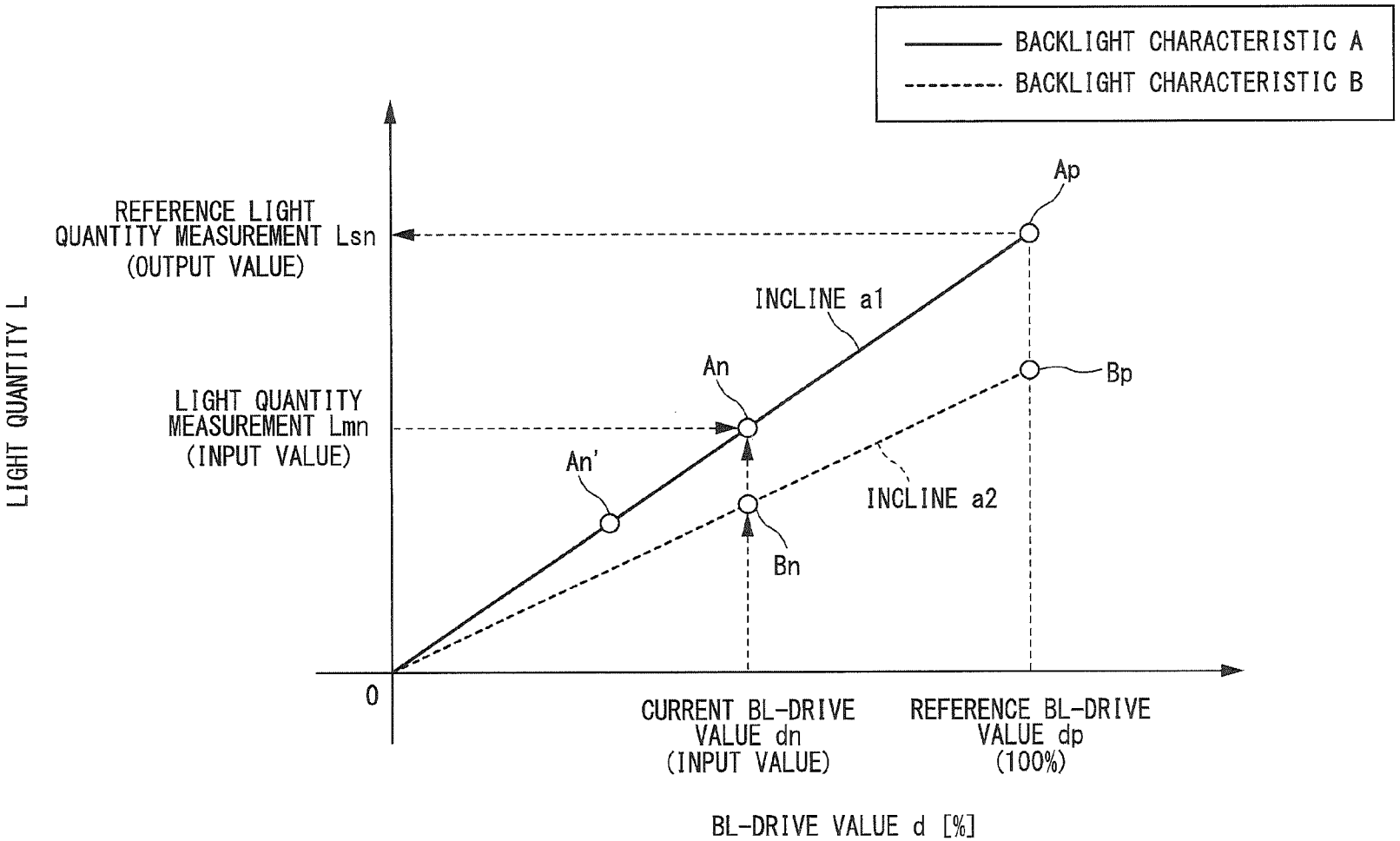
FIG. 4 is a graph used to explain the process of a drive normalization part according to the first embodiment of the present invention.

FIG. 4 is a graph used to explain the process of the drive normalization part 120 according to the first embodiment of the present invention.

Next, the process of the drive normalization part 120 will be described in detail with reference to FIG. 4.

The drive normalization part 20 of the present embodiment calculates the reference light quantity measurement Lsn based on the characteristic of the backlight 10 shown in FIG. 4. FIG. 4 is a graph showing the correlation between a light quantity L and an BL-drive value (Duty ratio) d by use of a vertical axis representing the quantity of light emitted from the backlight 10 and a horizontal axis representing a BL-drive value of a drive signal input to the backlight 10. That is, the graph of FIG. 4 shows the characteristic of the backlight 10 which varies the quantity of the emitted light based on the BL-drive value d of a drive signal input thereto.

When a BL-drive value is a Duty ratio of a pulse signal, it is possible to generalize the characteristic of the backlight 10 by use of Equation (1) since the quantity of light emitted from the backlight 10 varies in proportion to the Duty ratio (i.e. the BL-drive value d).

$$\text{Light quantity } L = a \times BL\text{-drive value } d \quad (1)$$

In the above, a coefficient a is a rate of change of the light quantity L against the BL-drive value d. As the coefficient a, it is possible to employ various values based on individual differences of the backlight 10, temperature drifting, and aged deterioration due to continuous driving. First, the drive normalization part 120 inputs the light quantity measurement Lmn and the current BL-drive value dn at the current time, thus specifying the coefficient a by way of a calculation of Equation (2).

$$a = \text{light quantity measurement } Lmn \div \text{current } BL\text{-drive value } dn \quad (2)$$

As shown in FIG. 4, the coefficient a representing a rate of change (i.e. an incline of a graph) is specified at a point An defined by the light quantity measurement Lmn and the current BL-drive value dn. Using a1 representing the specified coefficient a, for example, the characteristic of the backlight 10 ascribed to the coefficient (incline) al will be referred to as a backlight characteristic A.

After specifying the backlight characteristic A based on the calculation result of Equation (2), the drive normalization part 120 calculates the reference light quantity measurement Lsn by way of a calculation of Equation (3) using the specified coefficient (incline) a1.

$$\text{Reference light quantity measurement } Lsn = a1 \times \text{reference } BL\text{-drive value } dp \quad (3)$$

Herein, the reference BL-drive value dp is a fixed value which is predetermined with respect to the BL-drive value d. In this connection, the present embodiment determines the reference BL-drive value dp at 100%.

That is, the reference light quantity measurement Lsn calculated according to Equation (2) would be estimated as a light quantity measurement which is obtained from the optical sensor 13 when the backlight 10 currently having the backlight characteristic A is driven using the reference BL-drive value dp=100% (see a point Ap shown in FIG. 4).

Even when a point An', which is specified using the input light quantity measurement Lmn and the current BL-drive value dn, differs from a point An (see FIG. 4), for example, it is possible to calculate the same value of the reference light quantity measurement Lsn as long as the characteristic of the backlight 10 corresponds to the backlight characteristic A (see a solid-line graph shown in FIG. 4). That is, it is possible to calculate the same light quantity measurement (i.e. the reference light quantity measurement Lsn) irrespective of any value as the current BL-drive value dn as long as the backlight 10 has the same characteristic (i.e. the coefficient a).

On the other hand, the drive normalization part 120 calculates another coefficient (or incline) a2 different from the coefficient (or incline) a1 when a different value of the light quantity measurement Lmn (see a point Bn in FIG. 4) is obtained based on the same current BL-drive value dn at the point An (see FIG. 4). In this case, the characteristic of the backlight 10 will be referred to as a backlight characteristic B (see a dotted-line graph shown in FIG. 4). In the example of FIG. 4, the backlight characteristic B produces a lower light quantity of emission than that of the backlight characteristic A even when the same value as the current BL-drive value is applied to those characteristics. For example, the backlight characteristic of the backlight 10 may be changed from the backlight characteristic A to the backlight characteristic B due to temperature drifting ascribed to the continuous driving. In this case, the drive normalization part 120 specifies the backlight characteristic B (i.e. the incline a2 ) so as to input it to Equation (3), thus calculating the reference light quantity measurement Lsn based on the backlight characteristic B (see a point Bp shown in FIG. 4). The drive normalization part 120 outputs the calculated reference light quantity measurement Lsn to the low-pass filter 121.

In the above example, the drive normalization part 120 is supposed to calculate the reference light quantity measurement Lsn on the assumption that the BL-drive value and the quantity of light emitted from the backlight 10 would linearly vary based on the coefficient a. However, the liquid crystal display device 1 of the present embodiment is not necessarily limited to the above example. For example, it is possible for the backlight 10 to emit light based on the BL-drive value d such that the light quantity L can vary according to the predetermined function f (L=f(d)). In this case, the drive normalization part 120 specifies the function fat a single point (e.g. a point An), which is specified using the current BL-drive value do and the light quantity measurement Lmn, so as to input the reference BL-drive value dp (100%) to the specified function f, thus calculating the reference light quantity measurement Lmn.

Herein, the drive normalization part 120 successively inputs a series of light quantity measurements Lm, including the predetermined component of noise (e.g. a high-frequency component), from the optical sensor 13. Therefore, the drive normalization part 120 calculates and outputs the reference light quantity measurement Lsn including some noise. The low-pass filter 121 of the present embodiment successively inputs a series of reference light quantity measurements Lsn including some noise so as to calculate a moving average among them, thus outputting the smoothed reference light quantity measurement Lsnb. The calculated smoothed reference light quantity measurement Lsnb is input to the BL-drive value calculation part 123 through the limiter 122.

Next, the process of the BL-drive value calculation part 123 will be described in detail on the assumption that the limiter 122 directly outputs the smoothed reference light quantity measurement Lsnb without changing it. In this connection, the detailed function of the limiter 122 will be described later.

(Process of the BL-Drive Value Calculation Part)

Figure 5:
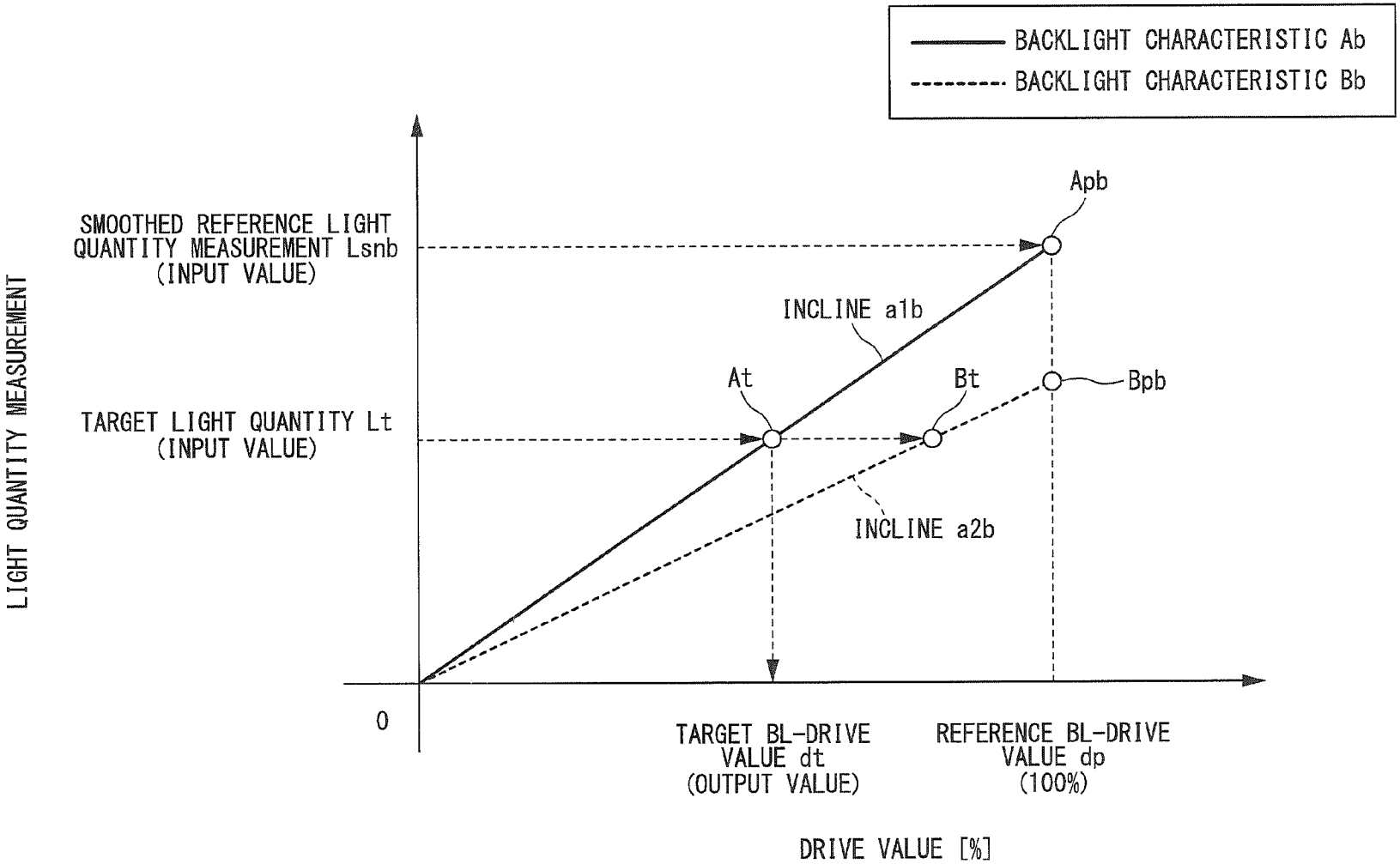
FIG. 5 is a graph used to explain the process of a BL-drive value calculation part according to the first embodiment of the present invention.

FIG. 5 is a graph used to explain the process of the BL-drive value calculation part 123 according to the first embodiment of the present invention.

Next, the process of the BL-drive value calculation part 123 will be described in detail with reference to FIG. 5.

The BL-drive value calculation part 123 sets a target BL-drive value dt based on the characteristic of the backlight 10 shown in FIG. 5. Similar to the graph of FIG. 4, the graph of FIG. 5 shows the characteristic of the backlight 10 which varies the quantity of the emitted light based on the BL-drive value d of the drive signal input thereto.

The BL-drive value calculation part 123 successively inputs a series of noise-eliminated values of the smoothed reference light quantity measurement Lsnb through the low-pass filter 121 (and the limiter 122). The BL-drive value calculation part 123 calculates a coefficient a1*b* representing the characteristic of the backlight 10 on the precondition that the optical sensor 13 obtains the light quantity measurement from the backlight 10 being driven using the reference BL-drive value dp=100% at the current time. The characteristic of the backlight 10 ascribed to the coefficient a1*b* will be referred to as a backlight characteristic Ab (see a solid-line graph shown in FIG. 5). It is possible to assume that the backlight characteristic Ab (i.e. incline a1*b*) would be regarded as a noise-eliminated value of the backlight characteristic A (i.e. incline a1) specified by the drive normalization part 120 in FIG. 4 since the backlight characteristic Ab is calculated based on the smoothed reference light quantity measurement Lsnb equivalent to a noise-eliminated value of the reference light quantity measurement Lsn.

Next, the BL-drive value calculation part 123 inputs a target light quantity Lt which is determined based on a user's setting of luminance The BL-drive value calculation part 123 calculates a BL-drive value (i.e. a target BL-drive value dt) to satisfy the target light quantity Lt with the backlight 10 having the specified backlight characteristic Ab (i.e. incline a1*b*). Specifically, the BL-drive value calculation part 123 calculates the target BL-drive value dt (see a point At shown in FIG. 5) by way of a calculation of Equation (4) using the specified incline a1*b*.

$$\text{Target } BL\text{-drive value } dt = \text{smoothed reference light quantity measurement Lsnb}/a1b \quad (4)$$

Upon calculating a backlight characteristic B (i.e. an incline a2) as the characteristic of the backlight 10, the drive normalization part 120 calculates and outputs a reference light quantity measurement Lsn at a point Bp. Subsequently, the low-pass filter 121 (and the limiter 122) eliminates noise from the reference light quantity measurement Lsn so as to produce a smoothed light quantity measurement Lsnb at a point Bpd (see FIG. 5), which is then input to the BL-drive value calculation part 123. Thus, the BL-drive value calculation part 123 specifies a backlight characteristic Bb (i.e. an incline a2*b*) at the point Bpb (see a dotted-line graph in FIG. 5). It is possible to assume that the backlight characteristic Bb (i.e. the incline a2*b*) would be regarded as a noise-eliminated value of the backlight characteristic B (i.e. the incline a2) specified by the drive normalization part 120 in FIG. 4.

In this case, the BL-drive value calculation part 123 calculates the target BL-drive value dt (see a point Bt in FIG. 5) to satisfy the target light quantity Lt with the backlight 10 having the backlight characteristic Bb based on the specified incline a2*b* and Equation (4). Thus, the BL-drive value calculation part 123 selects the target BL-drive value dt to achieve the target light quantity Lt based on a user's setting of luminance irrespective of the characteristic (either the backlight characteristic A or B) of the backlight 10.

As described above, the driving device 12 of the present embodiment is able to achieve a feedback control to normally maintain the light quantity of the backlight 10 at the target light quantity Lt even when the backlight 10 is continuously driven so as to drift the characteristic thereof due to temperature variations.

(Processes of a Control Determination Part and a BL-Drive Value Setting Part)

Next, the processes of the control determination part 124 and the BL-drive value setting part 125 shown in FIG. 3 will be described in detail.

First, the BL-drive value setting part 125 will be described below. The BL-drive value setting part 125 inputs the target BL-drive value dt calculated by the BL-drive value calculation part 123. The BL-drive value calculation part 123 carries out a process to set (or change) the current BL-drive value dn to a new value based on the target BL-drive value dt and the current BL-drive value dn which is set at the current time. Specifically, the BL-drive value setting part 125 calculates a BL-drive value d by way of a calculation of Equation (5).

$$\text{BL-drive value } d = k \times \text{target BL-drive value } dt + (1-k) \times \text{current BL-drive value } dn \quad (5)$$

In the above, the coefficient k is a numerical value satisfying an inequality of $0<k\leq 1$, i.e. a control coefficient representing a degree as to how the next BL-drive value d, which will be set by the BL-drive value setting part 125, approaches the target BL-drive value dt from the current BL-drive value dn. According to Equation (5), a larger value of the control coefficient k indicates that the next setting of the BL-drive value d is placed close to the target BL-drive value dt from the current BL-drive value dn while a smaller value of the control coefficient k indicates that the next setting of the BL-drive value d is placed close to the current BL-drive value dn. That is, the control coefficient k is used to change a feedback speed at which the quantity of the light emitted from the backlight 10 at the current time approaches the target light quantity dt.

Next, the control determination part 124 will be described below. The control determination part 124 inputs the target BL-drive value dt and the current BL-drive value dn so as to set the control coefficient k based on a difference between them. Specifically, the control determination part 124 calculates a difference Δd|dt−dn|, i.e. an absolute value of a difference between the target BL-drive value dt and the current BL-drive value dn. Thus, the control coefficient k is set to a large value k1 when the difference Δd exceeds the predetermined drive threshold dth while the control coefficient k is set to a value k2 smaller than the value k1 when the difference Δd becomes equal to or lower than the predetermined drive threshold dth.

For example, it is assumed that the drive threshold dth is 5%; the target BL-drive value dt which is calculated based on the target light quantity Lt after changing the user's setting of luminance is 30%; the current BL-drive value dn is 50%. In this case, the control determination part 124 calculates a difference Δd=20% based on the target BL-drive value dt (30%) and the current BL-drive value dn (50%), thus comparing the difference Δd with the drive threshold dth=5%. In this case, the control determination part 124 determines Δd>dth so as to set the control coefficient k to the large value k1 (e.g. k132 0.8), which is output to the BL-drive value setting part 125.

In the above, it is assumed that the current BL-drive value dn is decreased to 35% during the feedback control process of the driving device 12. Thus, the control determination part 124 calculates a difference Δd=5% based on the target BL-drive value dt (30%) and the current BL-drive value dn (35%), thus comparing the difference Δd with the drive threshold dth=5%. In this case, the control determination part 124 determines Δd≤dth so as to set the control coefficient k to a value k2 (e.g. k2=0.2) smaller than the value k1, which is output to the BL-drive value setting part 125.

As described above, the control determination part 124 and the BL-drive value setting part 125 carry out a process in which the current BL-drive value dn rapidly approaches the target BL-drive value dt when the current BL-drive value dn is deviated from the target BL-drive value dt by a certain degree, while they carry out a process of gradually changing the current BL-drive value dn to the target BL-drive value dt when the current BL-drive value dn approaches the target BL-drive value dt within a predetermined range. Thus, the control determination part 124 and the target BL-drive value setting part dt rapidly changes the current BL-drive value dn so as to improve a feedback speed when the current BL-drive value dn significantly differs from the target BL-drive value dt, while they gradually change the current BL-drive value dn so as to precisely match the current BL-drive value dn with the target BL-drive value dt when the current BL-drive value dn approaches the target BL-drive value dt within a certain range.

In this connection, the processes of the control determination part 124 and the BL-drive value setting part 125 are not necessarily limited to the foregoing processes. For example, it is possible for the control determination part 124 to store two or more drive thresholds dth1, dth2, . . . which differ from each other, thus setting three or more control coefficients k, which differ from each other, based on the relationship of magnitude between a difference Δd and each of the drive thresholds dth1, dth2, (Functional Configuration of a Limiter)

Figure 6:
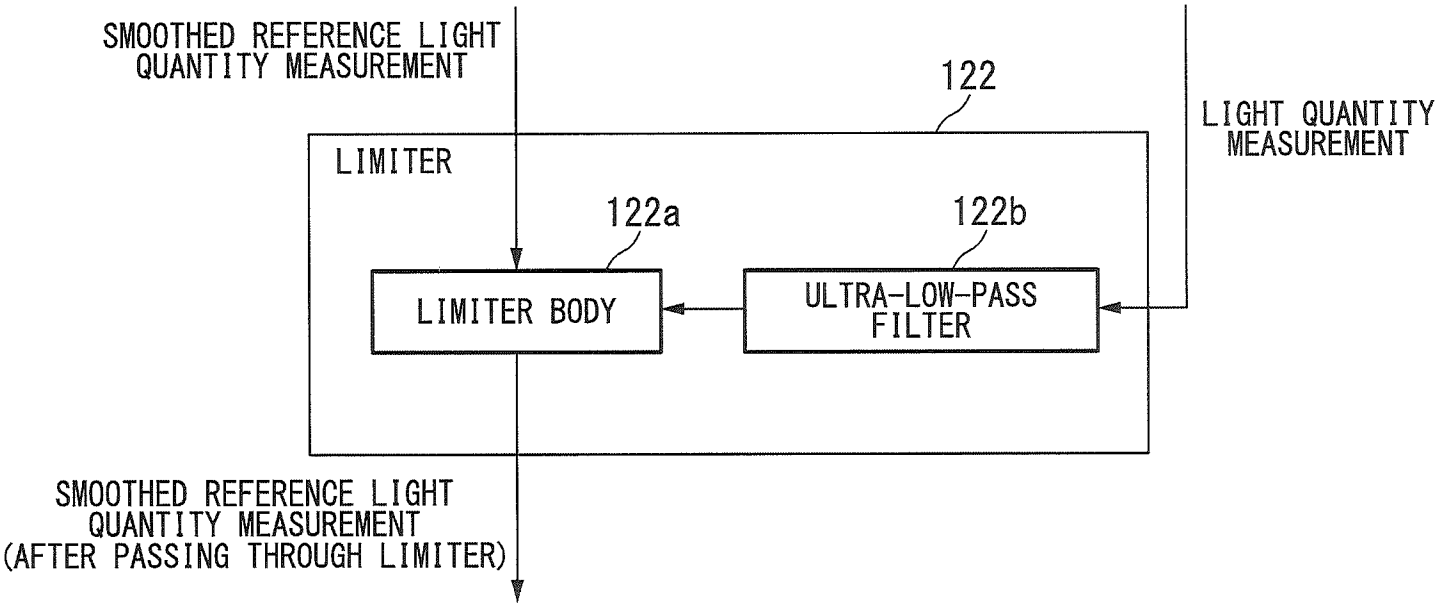
FIG. 6 is a block diagram showing the functional configuration of a limiter according to the first embodiment of the present invention.
Figure 7:
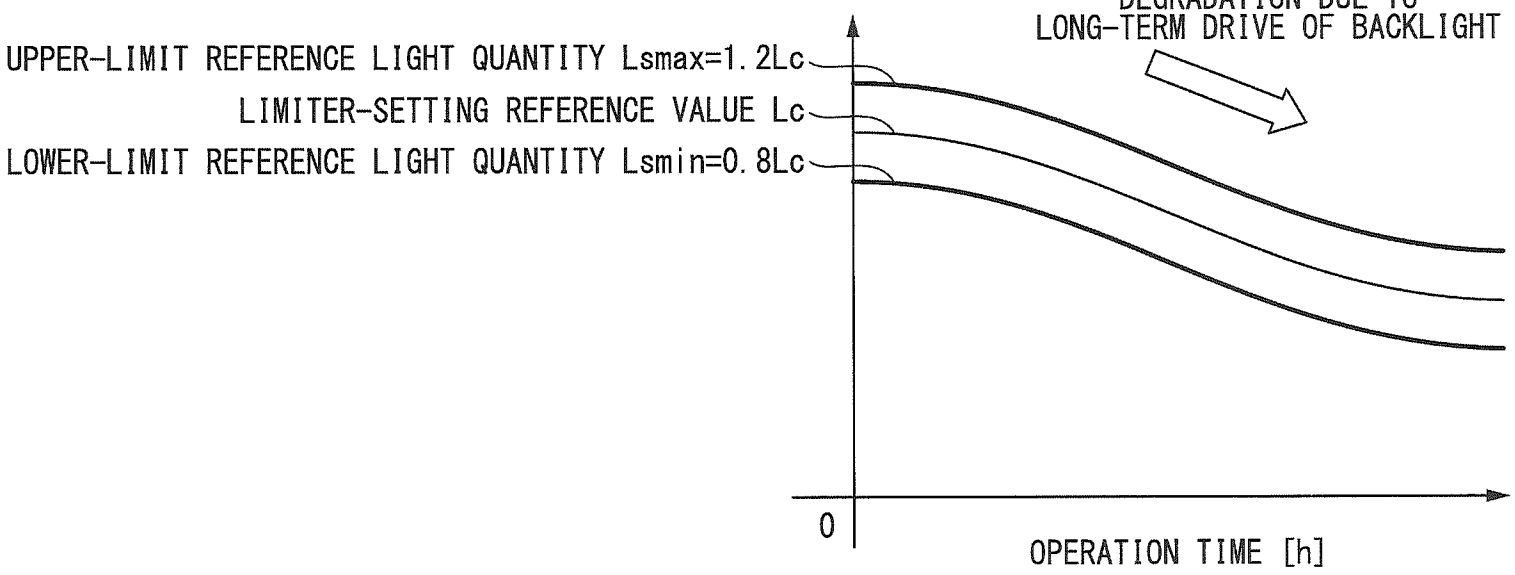
FIG. 7 is a graph used to explain the process of the limiter according to the first embodiment of the present invention.

FIG. 6 is a block diagram showing the functional configuration of the limiter 122 according to the first embodiment of the present invention. FIG. 7 is a graph used to explain the process of the limiter 122 according to the first embodiment of the present invention.

Next, the functional configuration and the process of the limiter 122 of the present embodiment will be described in detail with reference to FIGS. 6 and 7.

As shown in FIG. 6, the limiter 122 of the present embodiment includes a limiter body 122*a* and an ultra-low-pass filter 122*b*.

First, the limiter body 122*a* will be described below. The limiter body 122*a* successively inputs a series of smoothed reference light quantity measurements Lsnb from the ultra-low-pass filter 121 so as to determine the relationship of magnitude between the smoothed reference light quantity measurement Lsnb and the predetermined upper-limit light quantity Lsmax as well as the relationship of magnitude between the smoothed reference light quantity measurement Lsnb and the predetermined lower-limit reference light quantity Lsmin. According to the determination result in which the smoothed reference light quantity measurement Lsnb exceeds the upper-limit reference light quantity Lsmax, the limiter body 122*a* carries out a process to output the upper-limit reference light quantity Lsmax as the smoothed reference light quantity measurement Lsnb. When the smoothed reference light quantity measurement Lsnb is lower than the lower-limit reference Tight quantity Lsmin, the limiter body 122*a* carries out a process to output the lower-limit reference light quantity Lsmin as the smoothed reference light quantity measurement Lsnb.

Thus, the limiter 122 can prevent the luminance of the backlight 10 from oscillating due to a feedback control by normally containing the smoothed reference light quantity measurement Lsnb within the predetermined range (i.e. the range between Lsmin and Lsmax) even when the smoothed reference light quantity measurement Lsnb, which is smoothed by the low-pass filter 121, is rapidly and significantly changed due to unknown reasons.

As described above, the driving device 12 of the present embodiment is designed to carry out a feedback control solely based on the reference light quantity measurement Lsn precluding the dependency of the BL-drive value d via the drive normalization part 120. Therefore, the reference light quantity measurement Lsn may not reflect any rapid variation of the light quantity measurement Lmn caused by changing a user's setting of luminance Additionally, the low-pass filter 121 eliminates noise from the reference light quantity measurement Lsn (i.e. the smoothed reference light quantity measurement Lsnb). Therefore, it is possible to limit the elements of variations in the smoothed reference light quantity measurement Lsnb to the factors due to variations of the backlight characteristic, i.e. the factors due to temperature drifting in the medium-term driving, and the factors due to aged deterioration in the long-term driving.

Considering the above factors, it is sufficient for the driving device 12 to achieve a feedback control maintaining a constant luminance of the backlight 10 against gradual variations of the backlight characteristic in the medium-term driving. Therefore, no trouble occurs in the feedback control originally achieved by the driving device 12 even when the smoothed reference light quantity measurement Lsnb is compulsorily contained within the range between Lsmin and Lsmax in response to rapid and significant variations in the smoothed reference light quantity measurement Lsnb due to unknown reasons.

The limiter body 122*a* determines the upper-limit reference light quantity Lsmax and the lower-limit reference light quantity Lsmin based on a limiter-setting reference value Lc input from the ultra-low-pass filter 122*b* which will be described later.

Next, the function of the ultra-low-pass filter 122*b* will be described below. As shown in FIG. 6, the ultra-low-pass filter 122*b* successively inputs a series of reference light quantity measurements Lsn from the drive normalization part 120 so as to calculate a limiter-setting reference value Lc by carrying out a noise elimination process using a time constant larger than that of the low-pass filter 121. The ultra-low-pass filter 122*b* calculates a moving average based on the reference light quantity measurement Lsn in a range using an order of ten hours. FIG. 7 shows variations of the limiter-setting reference value Lc which is produced above. FIG. 7 shows a graph using a vertical axis representing a light quantity (Lc, Lsmax, Lsmin) and a horizontal axis representing a drive time of the backlight 10. Actually, the horizontal axis represents the drive time in the scale of time in the order of 1,000 hours.

FIG. 7 shows that a moving average (i.e. the limiter-setting reference value Lc) based on the reference light quantity measurement Lsn in the range of time in the order of ten hours in driving the backlight 10 will be gradually decreased along with an operating time in order of 1,000 hours. A reduction of the luminance of the backlight 10 depends on aged deterioration due to the driving time of the backlight 10. By calculating a moving average in the range of time in the order of ten hours, it is possible to eliminate any variation due to short-term noise and any variation of characteristics due to medium-term temperature drifting.

The limiter body 122*a* of the present embodiment determines the upper-limit reference light quantity Lsmax and the lower-limit reference light quantity Lsmin based on the limiter-setting reference value Lc output from the ultra-low-pass filter 122*b*. Specifically, the limiter body 122*a* sets the upper-limit reference light quantity Lsmax at Lsmax=1.2Lc while setting the lower-limit reference light quantity Lsmin at Lsmin=0.8Lc. That is, the limiter body 122*a* changes the range defined by Lsmin and Lsmax such that the limiter-setting reference value Lc will become the center of the range (see FIG. 7).

It is assumed that both the lower-limit reference light quantity Lsmin and the upper-limit reference light quantity Lsmax are fixed values not affected by aged deterioration of the backlight characteristic. On this assumption, a series of reference light quantity measurements Lsn successively output from the drive normalization part 120 will be gradually decreased depending on the long-term driving of the backlight 10, and therefore the drive normalization part 120 will not output higher values than the lower-limit reference light quantity Lsmin gradually. In this condition, the limiter 122 clips all the smoothed reference light quantity measurements Lsn, output from the low-pass filter 121, to the lower-limit reference light quantity Lsmin, thus disabling a feedback control function in which the light quantity of the backlight 10 approaches the target light quantity Lt.

For this reason, the limiter 122 of the present embodiment achieves the long-term usage of the liquid crystal display device 1 by appropriately changing the predetermined range (i.e. the range between Lsmin and Lsmax), which is determined for the purpose of suppressing the oscillation phenomenon in the feedback control, in conformity with variations of backlight characteristics due to aged deterioration.

(Flow of Processing of Driving Device 12)

Figure 8:
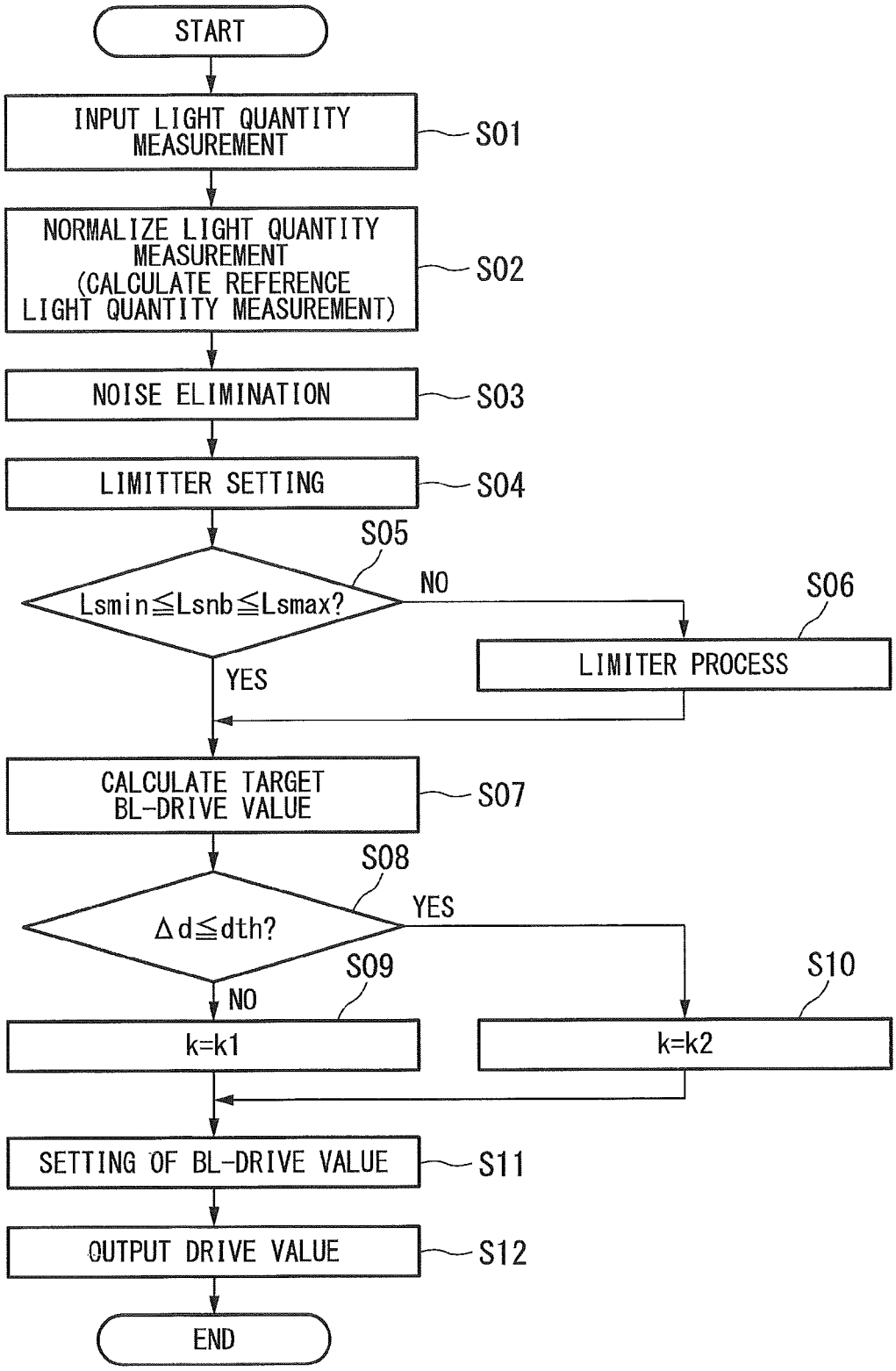
FIG. 8 is a flowchart showing a flow of processing of the driving device according to the first embodiment of the present invention.

FIG. 8 is a flowchart showing the process of the driving device 12 according to the first embodiment of the present invention.

Hereinafter, a flow of processing of the driving device 12 according to the present embodiment will be described with reference to FIG. 8.

First, the optical sensor 13 measures the light quantity of the backlight 10 so as to output a light quantity measurement Lmn representing the luminance of the backlight 10 at the current time (step S01).

Next, the drive normalization part 120 carries out a normalization process based on the light quantity measurement Lmn input from the optical sensor 13 and the current BL-drive value do input from the BL-drive value setting part 125 (step S02). Specifically, the drive normalization part 120 calculates the backlight characteristic (see FIG. 4) of the backlight 10 by Equation (2). Additionally, the drive normalization part 120 calculates the reference light quantity measurement Lsn based on the specified backlight characteristic by Equation (3). Thus, it possible to produce the reference light quantity measurement Lsn serving as a measured value which does not depend on the BL-drive value d.

Next, the low-pass filter 121 inputs the reference light quantity measurement Lsn from the drive normalization part 120 so as to calculate a moving average among a plurality of reference light quantity measurements input in the past. The low-pass filter 121 outputs the smoothed reference light quantity measurement Lsnb which is produced based on the moving average (step S03).

The ultra-low-pass filter 122*b* of the limiter 122 also inputs the reference light quantity measurement Lsn from the drive normalization part 120 so as to calculate a moving average among a plurality of reference light quantity measurements input in the past. The ultra-low-pass filter 122*b* calculates a moving average using a longer time constant, e.g. a moving average among reference light quantity measurements input in ten hours in the past. The ultra-low-pass filter 122*b* outputs a limiter-setting reference value Lc which is produced based on the moving average. The limiter body 122*b* of the limiter 122 inputs the limiter-setting reference value Lc from the ultra-low-pass filter 122*b* so as to set the upper-limit reference light quantity Lsmax and the lower-limit reference light quantity Lsmin based on the limiter-setting reference value Lc (step S04).

The limiter body 122*a* inputs the reference light quantity measurement Lsnb, which is calculated in step S03, so as to determine the relationship of magnitude between the reference light quantity measurement Lsnb and the upper-limit reference light quantity Lsmax or the lower-limit reference light quantity Lsmin (step S05). The limiter body 122*a* does not carry out any process so as to directly output the reference light quantity measurement Lsnb as long as the reference light quantity measurement Lsnb falls within the range between the upper-limit reference light quantity Lsmax and the lower-limit reference light quantity Lsmin (i.e. YES in step S05). On the other hand, the limiter body 122*a* carries out a process of setting the reference light quantity measurement Lsnb to either the upper-limit reference light quantity Lsmax or the lower-limit reference light quantity Lsmin (step S06) when the reference light quantity measurement Lsnb exceeds the upper-limit reference light quantity Lsmax or falls below the lower-limit reference light quantity Lsmin (i.e. NO in step S05).

Next, the BL-drive value calculation part 123 inputs the smoothed reference light quantity measurement Lsnb, which is calculated in step S03 or step S06, so as to specify the smoothed backlight characteristic of the backlight 10 (i.e. an inclination of a graph shown in FIG. 5). Then, the BL-drive value calculation part 123 inputs the target light quantity Lt, which is determined based on a user's setting of luminance, so as to calculate the target BL-drive value dt according to the specified backlight characteristic by way of a calculation of Equation (4) (step S07).

Next, the control determination part 124 inputs the target BL-drive value dt from the BL-drive value calculation part 123 so as to determine whether or not the target BL-drive value dt is equal to or below the predetermined drive threshold dth (step S08). When the target BL-drive value dt is equal to or below the drive threshold dth (i.e. YES in step S08), the control determination part 124 sets the control coefficient k to k1 (>k2) so as to output k1 to the BL-drive value setting part 125 (step S09). On the other hand, when the target BL-drive value dt exceeds the drive threshold dth (i.e. NO in step S08), the control determination part 124 sets the control coefficient k to k2 (<k1) so as to output k2 to the BL-drive value setting part 125 (step S10).

The BL-drive value setting part 125 calculates the next current BL-drive value dn based on the control coefficient k (either k1 or k2) input from the control determination part 124 (see Equation (5), step S11). Then, the drive signal output part 126 outputs a drive signal to the backlight 10 based on the current BL-drive value dn which is newly set in step S11 (step S12). The BL-drive value setting part 125 outputs the newly-set current BL-drive value dn to the drive normalization part 120 as well.

The optical sensor 13 detects the light quantity of the backlight 10, which is driven based on the current BL-drive value dn newly set in step S12, so as to obtain a new light quantity measurement Lmn, which is then output to the drive normalization part 120 again. Thereafter, the driving device 12 repeats a series of steps starting with step S01.

(Effect)

The driving device 12 of the present embodiment can produce the following effect by executing a flow of processing shown in FIG. 8.

First, it is assumed that, in step S07, the BL-drive value calculation part 123 inputs the target light quantity Lt which significantly varies by changing a user's setting of luminance On this assumption, the current BL-drive value dn will significantly vary by way of a series of steps S08 to S11 based on a variation of the target light quantity Lt, and therefore the backlight 10 will vary in luminance. In this case, the drive normalization part 120 newly inputs a light quantity measurement Lmn which varies solely depending on a variation of the current BL-drive value dn; hence, the backlight characteristic should not significantly vary before or after a variation of the current BL-drive value dn. In FIG. 4, for example, it is assumed that the point An indicates a correspondence between the current BL-drive value dn and the light quantity measurement Lmn before a user changes a setting of luminance. After a user changes a setting of luminance, the correspondence between dn and Lmn will change on the line of the backlight characteristic A (i.e. the incline a1) (see a point A' in FIG. 4). Therefore, the BL-drive value calculation part 123 should calculate the same value as the reference light quantity measurement Lsn based on the incline a1 before and after a user changes a setting of luminance.

As described above, the driving device 12 of the present embodiment converts the light quantity measurement Lmn input from the optical sensor 13 into the reference light quantity measurement Lsn, which does not depend on the current BL-drive value dn, by use of the drive normalization part 120 (step S02). The low-pass filter 121 carries out a noise elimination process on the reference light quantity measurement Lsn (step S03). Even when a user changes a setting of luminance, such a change is not reflected in the reference light quantity measurement Lsn subjected to the noise elimination process.

Therefore, the driving device 12 of the present embodiment can exclude an influence of a delayed output of the low-pass filter 121 from the process of changing the luminance in response to a setting of luminance being changed by a user; hence, it is possible to achieve a high-speed feedback control while suppressing oscillation.

In the driving device 12 of the present embodiment, the limiter 122 carries out a process of limiting the smoothed reference light quantity measurement Lsnb within the predetermined range of limitation (i.e. the range between the lower-limit reference light quantity Lsmin and the upper-limit reference light quantity Lsmax). Thus, even when the low-pass filter 121 outputs the smoothed reference light quantity measurement Lsnb which significantly varies due to unknown reasons, it is possible to minimize variations of the smoothed reference light quantity measurement Lsnb, thus preventing oscillation due to a feedback control.

The driving device of the present embodiment carries out a process of determining the range of limitation, which should be defined by the limiter 122, based on a certain value which is calculated based on a long-term moving average of the light quantity measurement Lmn (step S06).

Thus, the driving device 12 is able to dynamically optimize the range of limitation of the limiter 122 depending on aged deterioration due to the long-term driving of the backlight 10; hence, it is possible to maintain a stable feedback control after the long-term usage of the liquid crystal display device 1.

In the driving device 12 of the present embodiment, the control determination part 124 and the BL-drive value setting part 125 carry out a process of changing the speed (i.e. the feedback speed) at which the current BL-drive value dn approaches the target BL-drive value dt based on a difference Ad between the current BL-drive value dn and the target BL-drive value dt.

Thus, it is possible for the control determination part 124 and the BL-drive value setting part 125 to improve a feedback speed while maintaining the precision in which the current BL-drive value dn matches the target BL-drive value dt.

Next, an image display system according to the second embodiment of the present invention will be described below.

Figure 9:
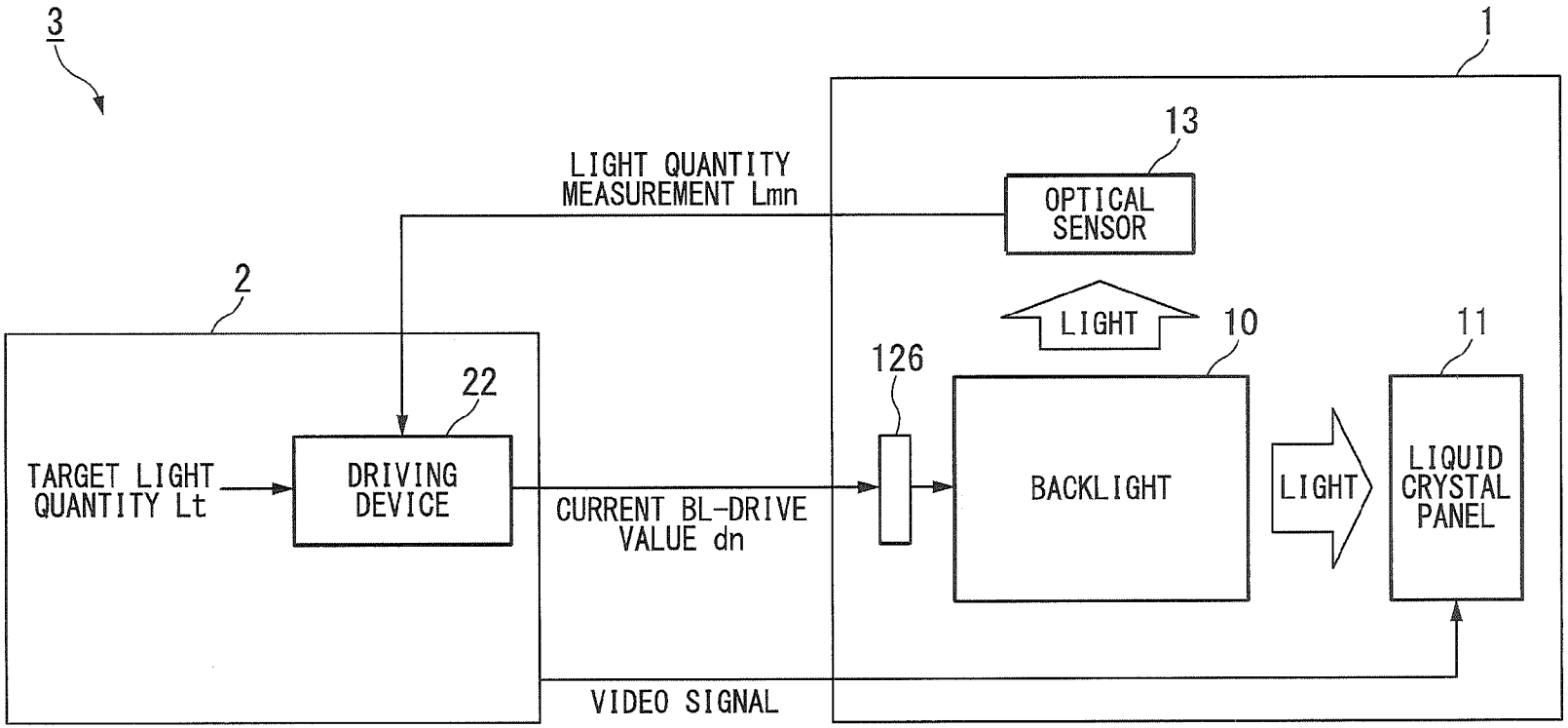
FIG. 9 is a block diagram showing the functional configuration of an image display system according to the second embodiment of the present invention.
Figure 10:
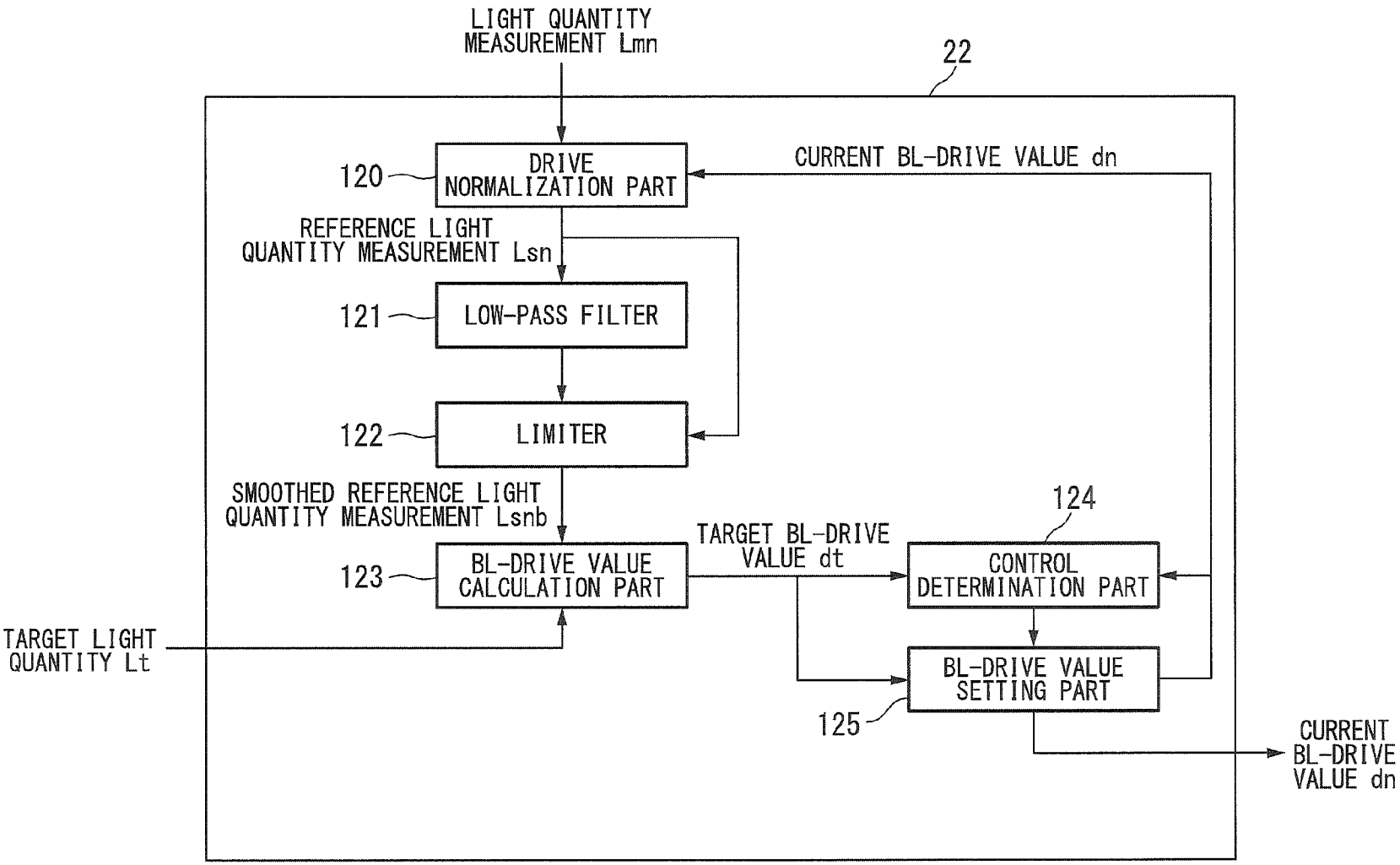
FIG. 10 is a block diagram showing the functional configuration of a driving drive according to the second embodiment of the present invention.

FIG. 9 is a block diagram showing the functional configuration of an image display system according to the second embodiment of the present invention. FIG. 10 is a block diagram showing the functional configuration of a driving device according to the second embodiment of the present invention. In FIGS. 9 and 10, the same parts as those of the first embodiment are denoted using the same reference signs; hence, descriptions thereof will be omitted.

As shown in FIG. 9, an image display system 3 according to the second embodiment of the present invention includes the liquid crystal display device 1 and a control device 2.

The liquid crystal display device 1 is a liquid crystal display including the backlight 10, the liquid crystal panel 11, and the optical sensor 13. Additionally, the liquid crystal display device 1 includes the drive signal output part 126 which receives a current BL-drive value dn from an external device (i.e. the control device 2) so as to output a drive signal to the backlight 10.

The control device 2 includes a driving device 22. The control device 2 of the present embodiment is a general-purpose PC (i.e. a personal computer) which is connected to the liquid crystal display device 1, i.e. a liquid crystal display, through the predetermined cable. The control device 2, i.e. a general-purpose PC, transmits the predetermined video signal, representing a video to be displayed, to the liquid crystal panel 11 of the liquid crystal display device 1 through a video-signal cable. Upon receiving a user's input operation, the control device 2 supplies a target light quantity Lt, corresponding to a setting of luminance specified by the user's input operation, to the driving device 22.

As shown in FIG. 10, the driving device 22 includes the drive normalization part 120, the low-pass filter 121, the limiter 122, the BL-drive value calculation part 123, the control determination part 124, and the BL-drive value setting part 125.

The driving device 22 successively inputs a series of light quantity measurements Lmn from the liquid crystal display device 1 through the predetermined communication cable. The driving device 22 sets the current BL-drive value dn based on the light quantity measurement Lmn and the target light quantity Lt (see a series of steps S01 to S11 in FIG. 8), thus transmitting the current BL-drive value dn to the drive signal output part 126.

As described above, the image display system 3 of the present embodiment is designed such that the function of the driving device 12 of the first embodiment (precluding the drive signal output part 126) is not installed in the main body of the liquid crystal display device 1 but installed in the control device 2 serving as an external device.

Owing to the aforementioned configuration of the image display system 3 according to the second embodiment of the present invention, it is possible to obtain the same effect as the first embodiment without installing a driving device configured to carry out a feedback control (see a series of steps S01 to S11 in FIG. 8) in the liquid crystal display device 1.

The image display device 3 of the present embodiment may include a plurality of liquid crystal display devices 1, one of which is connected to the control device 2. In this case, the driving device 22 of the control device 2 may have a function to carry out a feedback control independently for each of the liquid crystal display devices 1.

Thus, it is possible to reconfigure the control device 2, i.e. a general-purpose PC, to achieve the function of a control server which is able to concurrently control a plurality of liquid crystal display devices 1 in luminance.

The second embodiment is described such that the liquid crystal display device 1 is wire-connected to the control device 2 through the predetermined communication cable; but this is not a limitation to the image display system 3 of the present embodiment. For example, it is possible to mutually transmit or receive the light quantity measurement Lmn and the current BL-drive value do through the predetermined wireless communication means.

It is possible to store programs, achieving the functions of the driving devices 12 and 22 according to the first and second embodiments of the present invention, in computer-readable storage media. Thus, it is possible to realize a flow of processing shown in FIG. 8 by loading and executing programs stored in storage media with a computer system (e.g. a CPU (Central Processing Unit) or the like).

The "computer-readable storage media" refer to flexible disks, magneto-optic disks, ROM, portable media such as CD-ROM, and storage devices such as hard disks installed in computer systems. Additionally, the "computer-readable storage media" may embrace any measure able to hold programs for a certain time such as volatile memory installed in computer systems acting as servers or clients. The foregoing programs may achieve part of the foregoing functions, or the foregoing programs may achieve the foregoing functions when combined with other programs pre-installed in computer systems. Alternatively, the foregoing programs can be stored in the predetermined server, and therefore those programs can be distributed (or downloaded) to user equipment through communication lines in response to a request from another device.

The present invention has been described in detail by way of embodiments with reference to the drawings, although specific configurations are not necessarily limited to those embodiments; hence, the present invention should embrace design choices without departing from the subject matter of the invention.

REFERENCE SIGNS LIST

1 liquid crystal display device
10 backlight
11 liquid crystal panel
12, 22 driving device
120 drive normalization part
121 low-pass filter
122 limiter
123 BL-drive value calculation part
124 control determination part
125 BL-drive value setting part
126 drive signal output part
13 optical sensor
2 control device
3 image display system

The invention claimed is:

1. A driving device configured to change a quantity of light emitted from a backlight based on a predetermined BL-drive value, comprising:

a drive normalization part configured to calculate a reference light quantity measurement representing a light quantity measurement which is estimated and obtained from an optical sensor when the backlight is driven using a predetermined reference BL-drive value at a current time based on a current BL-drive value, representing a BL-drive value at the current time, and a light quantity measurement, representing a numerical value of a light quantity of the backlight driven by the current BL-drive value, which is obtained from the optical sensor;

a low-pass filter configured to calculate a moving average among a plurality of reference light quantity measurements being temporarily held, thus outputting a smoothed reference light quantity measurement precluding noise; and a BL-drive value calculation part configured to calculate a target BL-drive value representing a BL-drive value which allows the smoothed reference light quantity measurement to match a target light quantity based on the smoothed reference light quantity measurement and the target light quantity based on a user's setting of luminance.

2. The driving device according to claim 1, further comprising a limiter configured to output an upper-limit reference light quantity as the smoothed reference light quantity measurement when the smoothed reference light quantity measurement exceeds the predetermined upper-limit reference light quantity while outputting a lower-limit reference light quantity as the smoothed reference light quantity measurement when the smoothed reference light quantity measurement becomes lower than the predetermined lower-limit reference light quantity.

3. The driving device according to claim 2, wherein the limiter sets the upper-limit reference light quantity and the lower-limit reference light quantity based on the plurality of reference light quantity measurements and a limiter-setting reference value which is obtained by carrying out a noise elimination process using a time constant larger than a time constant of the low-pass filter.

4. The driving device according to claim 1, further comprising a control determination part configured to set a control coefficient based on a difference between the target BL-drive value and the current BL-drive value; and a BL-drive value setting part configured to newly set the current BL-drive value based on the target BL-drive value, the current BL-drive value, and the control coefficient.

5. A liquid crystal display device comprising:

the driving device according to claim 1;

the backlight; and the optical sensor configured to produce the light quantity measurement representing a quantity of light emitted from the backlight.

6. A driving method for changing a quantity of a light emitted from a backlight based on a predetermined BL-drive value, comprising:

calculating a reference light quantity measurement representing a light quantity measurement which is estimated and obtained from an optical sensor when the backlight is driven using a predetermined reference BL-drive value at a current time based on a current BL-drive value, representing a BL-drive value at the current time, and a light quantity measurement, representing a numerical value of a light quantity of the backlight driven by the current BL-drive value, which is obtained from the optical sensor;

calculating a moving average among a plurality of reference light quantity measurements being temporarily held, thus outputting a smoothed reference light quantity measurement precluding noise; and calculating a target BL-drive value representing a BL-drive value which allows the smoothed reference light quantity measurement to match a target light quantity based on the smoothed reference light quantity measurement and the target light quantity based on a user's setting of luminance.

7. A non-transitory computer-readable recording medium storing a program causing a computer of a driving device, configured to change a quantity of light emitted from a backlight based on a predetermined BL-drive value, to execute:

calculating a reference light quantity measurement representing a light quantity measurement which is estimated and obtained from an optical sensor when the backlight is driven using a predetermined reference BL-drive value at a current time based on a current BL-drive value, representing a BL-drive value at the current time, and a light quantity measurement, representing a numerical value of a light quantity of the backlight driven by the current BL-drive value, which is obtained from the optical sensor;

calculating a moving average among a plurality of reference light quantity measurements being temporarily held, thus outputting a smoothed reference light quantity measurement precluding noise; and calculating a target BL-drive value representing a BL-drive value which allows the smoothed reference light quantity measurement to match a target light quantity based on the smoothed reference light quantity measurement and the target light quantity based on a user's setting of luminance.

* * * * *